US011999551B1

(12) United States Patent
Luo et al.

(10) Patent No.: US 11,999,551 B1
(45) Date of Patent: Jun. 4, 2024

(54) VACUUMIZING SEALING TANK

(71) Applicant: Tonglu Wanshan Stationery Co., Ltd, Hangzhou (CN)

(72) Inventors: Zhenfei Luo, Hangzhou (CN); Chan Ka Fai Kenneth, Hangzhou (CN)

( * ) Notice: Subject to any disclaimer, the term of this patent is extended or adjusted under 35 U.S.C. 154(b) by 0 days.

(21) Appl. No.: 18/418,499

(22) Filed: Jan. 22, 2024

(51) Int. Cl.
*B65D 81/20* (2006.01)
*B65D 43/02* (2006.01)
*B65D 53/02* (2006.01)

(52) U.S. Cl.
CPC ..... *B65D 81/2038* (2013.01); *B65D 43/0202* (2013.01); *B65D 53/02* (2013.01); *B65D 81/2015* (2013.01); *B65D 2543/00194* (2013.01); *B65D 2543/00972* (2013.01)

(58) Field of Classification Search
CPC ..... B65D 81/2038; B65D 43/0202; B65D 53/02; B65D 81/2015; B65D 2543/00194; B65D 2543/00972
USPC ..... 220/231; 215/262
See application file for complete search history.

(56) References Cited

U.S. PATENT DOCUMENTS 3,672,114 A * 6/1972 Sacks ..... B65B 31/047 53/88
6,644,489 B2 * 11/2003 Chang ..... B65D 81/2038 215/311
6,994,227 B2 * 2/2006 Kwon ..... A47J 47/10 220/203.11
11,203,478 B2 * 12/2021 Wei ..... B65D 45/20
2013/0146500 A1 * 6/2013 Kim ..... B65D 81/2038 206/524.8

* cited by examiner

*Primary Examiner* — James N Smalley

(57) ABSTRACT

The present disclosure discloses a vacuumizing sealing tank including a body and a cover; the body having an accommodating cavity with an upward opening; and the cover detachably installed on top of the body, covering and sealing the opening of the accommodating cavity; wherein the cover is provided with a vacuumizing device and a deflating component, the vacuumizing device being an air bag vacuumizing device that compresses the air bag to exhaust air in the accommodating cavity to achieve a vacuum state, and the deflating component deflating the accommodating cavity. The vacuumizing device and the deflating component are provided. After a stuff to be stored is placed in the accommodating cavity and the cover is on, the accommodating cavity may be vacuumized through the vacuumizing device, so that the stuff to be stored may keep fresh for a long time in the vacuum state.

9 Claims, 3 Drawing Sheets

VACUUMIZING SEALING TANK

TECHNICAL FIELD

The present disclosure relates to the technical field of container, and more specifically to a vacuumizing sealing tank.

BACKGROUND

Storage tanks are common daily supplies. A conventional storage tank is composed of a body and a cover. The body has an accommodating cavity with an upward opening. The cover is provided on the body, covering the opening of the accommodating cavity. After food, cosmetics, medicine or the like is put into the accommodating cavity of the body and the cover is on, those in the body may be isolated from outside, separated from dust, bacteria and the like. This guarantees freshness of those within the tank.

However, after the storage tank is filled and sealed, there is still air in the tank, failing to achieve a vacuum state, and thus failing to be preserved for a long term. Therefore, it is desired that the current storage tanks shall be improved.

SUMMARY

In view of this problem, the present disclosure is mainly directed to provide a vacuumizing sealing tank that is able to effectively solve the existing problem of long-term preservation by storage tanks.

In order to achieve the objective as described in the above, the present disclosure applies the following technical solution.

A vacuumizing sealing tank includes a body and a cover. The body has an accommodating cavity with an upward opening. The cover detachably installed on top of the body, covering and sealing the opening of the accommodating cavity. The cover is provided with a vacuumizing device and a deflating component. The vacuumizing device is an air bag vacuumizing device that compresses the air bag to exhaust air in the accommodating cavity to achieve a vacuum state. The deflating component deflates the accommodating cavity.

Preferably, a top of the cover is concavely provided with an installation cavity. A bottom of the installation cavity is provided with a first air hole communicating the accommodating cavity. The vacuumizing device includes an air bag, a lower one-way valve, an upper one-way valve, a pressing button and a support spring. The air bag is pressably provided in the installation cavity. The air bag has a compression air cavity inside. A top of the air bag is provided with a second air hole communicating the compression air cavity and outside. The lower one-way valve is provided in the first air hole to enable the accommodating cavity to communicate the compression air cavity in one way. The upper one-way valve is provided in the second air hole to enable the compression air cavity to communicate the outside in one way. The pressing button is provided on top of the air bag and in the installation cavity to enable the air bag to compress downward. The support spring is provided in the compression air cavity to enable the air bag to be restored upwards.

Preferably, a center of the bottom of the installation cavity is convexly provided with a bump. The first air hole is on the bump. A lower opening of the air bag sheathes the bump. The air bag is sealed and fixedly installed to the bump via a first sealing ring.

Preferably, an inner side wall of the installation cavity is concavely provided with a guide groove extending vertically. An outer side wall of the pressing button is convexly provided with a guide portion moving up and down the guide groove.

Preferably, the inner side wall of the installation cavity is concavely provided with a lock groove that is located beside a lower end of the guide groove and that communicates the lower end of the guide groove. The pressing button is a rotating pressing button. In response to the pressing button being pressed to an extreme position, the pressing button rotates to lead the guide portion rotating and locked into the lock groove.

Preferably, there are two guide grooves provided symmetrically. Correspondingly, there are two guide portions provided radially and symmetrically and two lock grooves provided radially and symmetrically.

Preferably, a decorating cover plate is provided in the installation cavity. The decorating cover plate is provided with a spacing hole. The pressing button passes the spacing hole to extend upwards.

Preferably, the cover is provided with an installation hole communicating outside and the accommodating cavity. The deflating component includes a button member, a deflating spring and a deflating sealing ring. The button member is provided movable up and down in the installation hole. A lower end of the button member extends into the accommodating cavity. The deflating spring sheathes an upper end of the button member and pushes the button member to move upwards. The deflating sealing ring sheathes the lower end of the button member and is located in the accommodating cavity. The deflating sealing ring seals or opens a lower opening of the installation hole as the button member moves up and down.

Preferably, the installation hole is located beside the installation cavity.

Preferably, the cover is provided with a second sealing ring clamped between the cover and the body to seal the opening of the accommodating cavity.

Compared with existing technologies, the present disclosure is evidently advantageous and beneficially effective. In particular, the following is known from the technical solution.

The vacuumizing device and the deflating component are provided. After a stuff to be stored is placed in the accommodating cavity and the cover is on, the accommodating cavity may be vacuumized through the vacuumizing device, so that the stuff to be stored may keep fresh for a long time in the vacuum state. Besides, the deflating component may be applied to relieve the vacuum state, so that it is easy to open the cover, which brings about convenience for use.

| Reference signs | |
|---|---|
| 10: body | 11: accommodating cavity |
| 20: cover | 21: second sealing ring |
| 22: installation cavity | 23: first air hole |

-continued

| Reference signs | |
|---|---|
| 24: bump | 25: guide groove |
| 26: lock groove | 27: installation hole |
| 30: vacuumizing device | 31: air bag |
| 32: lower one-way valve | 33: upper one-way valve |
| 34: pressing buttom | 35: support spring |
| 36: first sealing ring | 37: decorating cover plate |
| 40: deflating component | 41: button member |
| 42: deflating spring | 43: deflating sealing ring |
| 301: compression air cavity | 302: second air hole |
| 303: guide portion | 304: spacing hole |

DETAILED DESCRIPTION OF THE EMBODIMENTS

Figure 1:
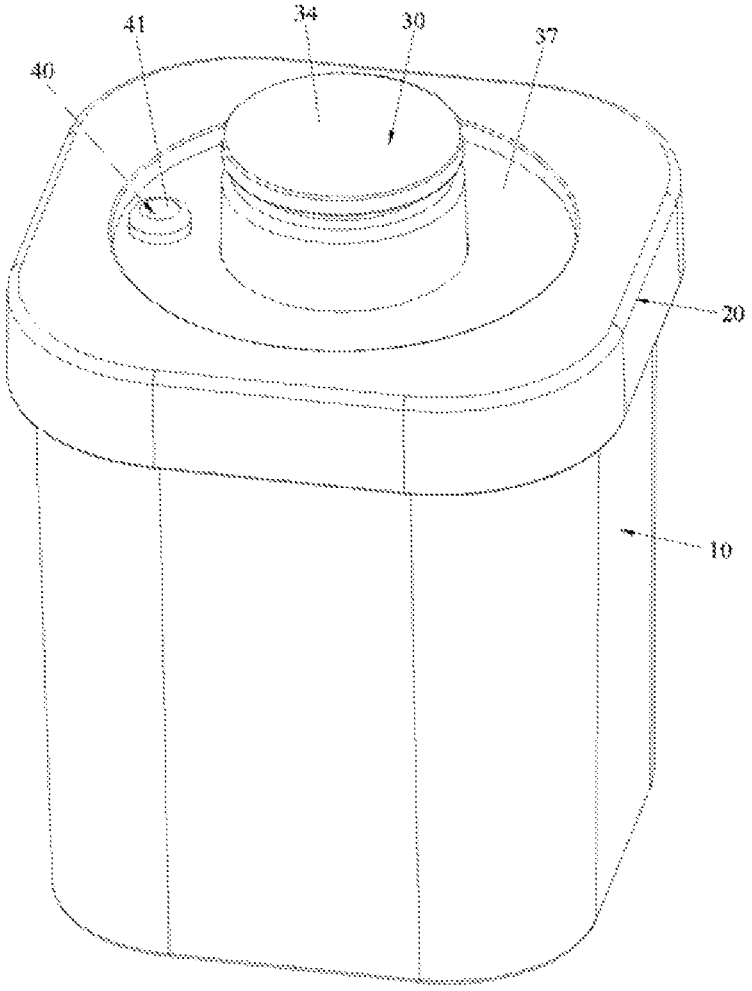
FIG. 1 is an assembled three-dimensional view of a preferable embodiment of the present disclosure.
Figure 2:
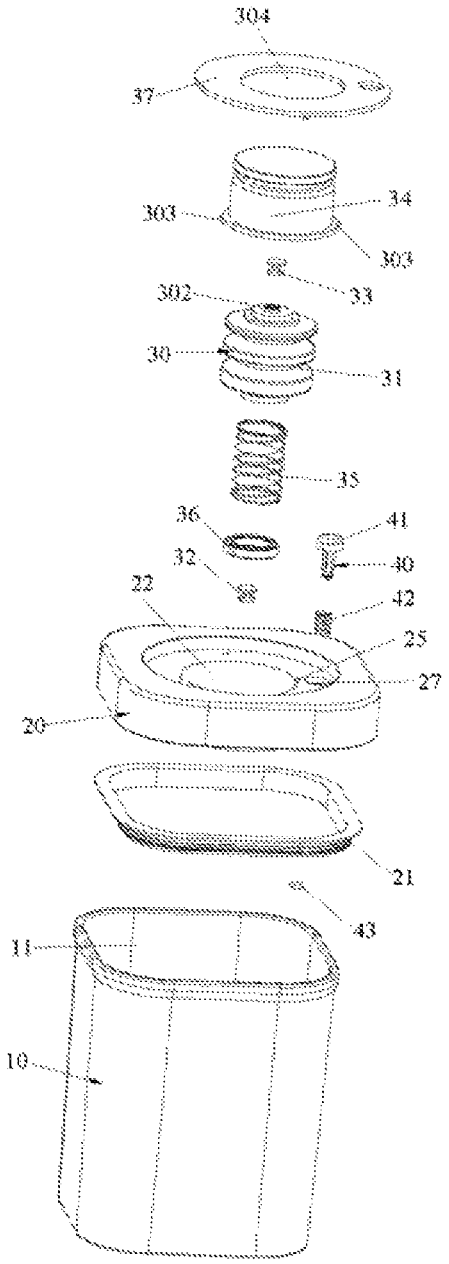
FIG. 2 is an exploded view of the preferable embodiment of the present disclosure.
Figure 3:
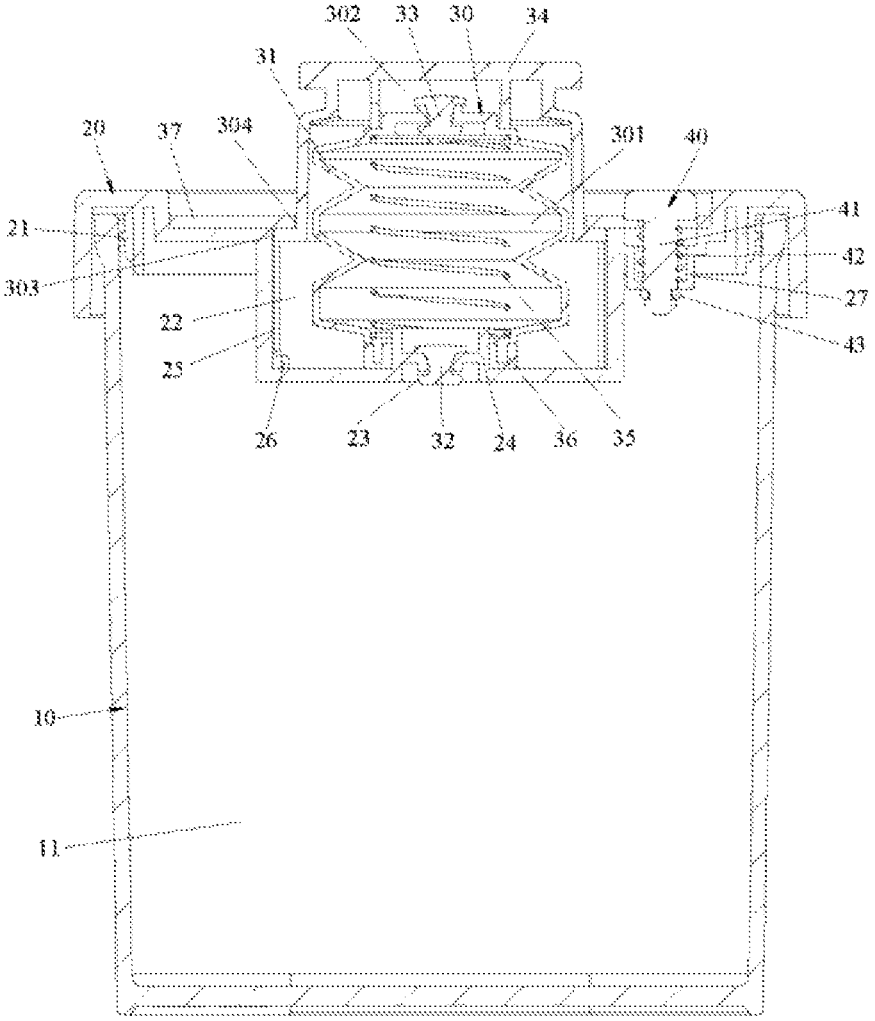
FIG. 3 is a sectional view of the preferable embodiment of the present disclosure.

FIG. 1 to FIG. 3 show a particular structure of a preferable embodiment of the present disclosure, including a body 10 and a cover 20.

The body 10 has an accommodating cavity 11 with an upward opening. The body 10 may be but not limited to plastic or glass.

The cover 20 is detachably installed on top of the body 10, covering and sealing the opening of the accommodating cavity 11. In this embodiment, the cover 20 is provided with a second sealing ring 21 clamped between the cover 20 and the body 10 to seal the opening of the accommodating cavity 11. Therefore, a fine sealing structure is formed, preventing outer air from entering the accommodating cavity 11. Besides, a top of the cover 20 is concavely provided with an installation cavity 22. A bottom of the installation cavity 22 is provided with a first air hole 23 communicating the accommodating cavity 11. A center of the bottom of the installation cavity 22 is convexly provided with a bump 24. The first air hole 23 is on the bump 24. An inner side wall of the installation cavity 22 is concavely provided with a guide groove 25 extending vertically. The inner side wall of the installation cavity 22 is concavely provided with a lock groove 26 that is located beside a lower end of the guide groove 25 and that communicates the lower end of the guide groove 25. There are two guide grooves 25 provided symmetrically, and correspondingly, there are two lock grooves 25 provided radially and symmetrically. Further, the cover 20 is provided with an installation hole 27 communicating outside and the accommodating cavity 11, and the installation hole 27 is located beside the installation cavity 22.

The cover 20 is provided with a vacuumizing device 30 and a deflating component 40. The vacuumizing device 30 is an air bag vacuumizing device that compresses an air bag 31 to exhaust air in the accommodating cavity 11 to achieve a vacuum state. The deflating component 40 deflates the accommodating cavity 11. A particular description is as follows.

The vacuumizing device 30 includes the air bag 31, a lower one-way valve 32, an upper one-way valve 33, a pressing button 34 and a support spring 35. The air bag 31 is pressably provided in the installation cavity 22. The air bag 31 has a compression air cavity 301 inside. A top of the air bag 31 is provided with a second air hole 302 communicating the compression air cavity 301 and the outside. The lower one-way valve 32 is provided in the first air hole 23 to enable the accommodating cavity 11 to communicate the compression air cavity 301 in one way. The upper one-way valve 33 is provided in the second air hole 302 to enable the compression air cavity 301 to communicate the outside in one way. The pressing button 34 is provided on top of the air bag 31 and in the installation cavity 22 to enable the air bag 31 to compress downward. The support spring 35 is provided in the compression air cavity 301 to enable the air bag 31 to be restored upwards. In this embodiment, a lower opening of the air bag 31 sheathes the bump 24, and the air bag 31 is sealed and fixedly installed to the bump 24 via a first sealing ring 36. This structure is simple and is assembled easily. Further, an outer side wall of the pressing button 34 is convexly provided with a guide portion 303 moving up and down the guide groove 25. The pressing button 34 is a rotating pressing button. When the pressing button 34 is pressed down to an extreme position, the pressing button 34 rotates to lead the guide portion 303 rotating and locked into the lock groove 26, so that the pressing button 34 is fixed from springing back. Meanwhile, the pressing button 34 is not higher than a top surface of the cover 20, and thereby a size of the tank is small, facilitating transportation. Besides, there are two guide portions 303 provided radially and symmetrically. Moreover, a decorating cover plate 37 is provided in the installation cavity 22. The decorating cover plate 37 is provided with a spacing hole 304, and the pressing button 34 passes the spacing hole 304 to extend upwards. The decorating cover plate 37 is configured to limit a springing height of the pressing button 34.

The deflating component 40 includes a button member 41, a deflating spring 42 and a deflating sealing ring 43. The button member 41 is provided movable up and down in the installation hole 27. A lower end of the button member 41 extends into the accommodating cavity 11. The deflating spring 42 sheathes an upper end of the button member 41 and pushes the button member 41 to move upwards. The deflating sealing ring 43 sheathes the lower end of the button member 41 and is located in the accommodating cavity 11. The deflating sealing ring 43 seals or opens a lower opening of the installation hole 27 as the button member 41 moves up and down.

An operation principle of this embodiment is as follows.

In use, when the pressing button 34 is pressed down, the pressing button 34 squeezes the air bag 31. When the air bag 31 is compressed, the lower one-way valve 32 is automatically closed under air pressure, and the upper one-way valve 33 is automatically open to exhaust air in the compression air cavity 301. In the meantime, the support spring 35 is compressed. When the pressing button 34 is released, the support spring 35 in the air bag 31 springs back. The upper one-way valve 33 is automatically closed under air pressure. The lower one-way valve 32 is automatically open, and air in the accommodating cavity 11 of the body 10 flows into the compression air cavity 301. By repetition of the operations, the air in the accommodating cavity 11 of the body 10 may be exhausted so that the accommodating cavity 11 achieves a vacuum state.

When the cover 20 is to be opened, the button member 41 is pressed to compress the deflating spring 42. The button member 41 leads the deflating sealing ring 43 down, so that the lower opening of the installation hole 27 is open and the outer air flows into the accommodating cavity 11 of the body 10 through the installation hole 27. As a result, the vacuum state may be relieved and the cover 20 may easily be opened.

A key point of the design of the present disclosure is as follows. The vacuumizing device and the deflating component are provided. After a stuff to be stored is placed in the accommodating cavity and the cover is on, the accommodating cavity may be vacuumized through the vacuumizing device, so that the stuff to be stored may keep fresh for a long time in the vacuum state. Besides, the deflating component may be applied to relieve the vacuum state, so that it is easy to open the cover, which brings about convenience for use.

The technical principle of the present disclosure is described with the particular embodiment. The description is only directed to explain the principle of the present disclosure, but can not be explained as limitation to the protection scope of the present disclosure in any manner. Based on the explanation, those skilled in the art may deem of other particular embodiments of the present disclosure without any inventive effort. All these embodiments fall into the protection scope of the present disclosure.

What is claimed is:

1. A vacuumizing sealing tank, comprising a body and a cover; the body having an accommodating cavity with an upward opening; and the cover detachably installed on top of the body, covering and sealing the opening of the accommodating cavity; wherein the cover is provided with a vacuumizing device having an air bag configured to inflate and deflate with air and a deflating component, the vacuumizing device also having an air bag vacuumizing device that compresses the air bag to exhaust air in the accommodating cavity to achieve a vacuum state, and the deflating component deflating the accommodating cavity; and, wherein a top of the cover is concavely provided with an installation cavity, a bottom of the installation cavity is provided with a first air hole communicating the accommodating cavity; the vacuumizing device includes an air bag, a lower one-way valve, an upper one-way valve, a pressing button and a support spring; the air bag is pressably provided in the installation cavity, the air bag has a compression air cavity inside, and a top of the air bag is provided with a second air hole communicating the compression air cavity and outside; the lower one-way valve is provided in the first air hole to enable the accommodating cavity to communicate the compression air cavity in one way; the upper one-way valve is provided in the second air hole to enable the compression air cavity to communicate the outside in one way; the pressing button is provided on top of the air bag and in the installation cavity to enable the air bag to compress downward; and the support spring is provided in the compression air cavity to enable the air bag to be restored upwards.

2. The vacuumizing sealing tank according to claim 1, wherein a center of the bottom of the installation cavity is convexly provided with a bump, the first air hole is on the bump, a lower opening of the air bag sheathes the bump, and the air bag is sealed and fixedly installed to the bump via a first sealing ring.

3. The vacuumizing sealing tank according to claim 1, wherein an inner side wall of the installation cavity is concavely provided with a guide groove extending vertically, and an outer side wall of the pressing button is convexly provided with a guide portion moving up and down the guide groove.

4. The vacuumizing sealing tank according to claim 3, wherein the inner side wall of the installation cavity is concavely provided with a lock groove that is located beside a lower end of the guide groove and that communicates the lower end of the guide groove, the pressing button is a rotating pressing button, and in response to the pressing button being pressed to an extreme position, the pressing button rotates to lead the guide portion rotating and locked into the lock groove.

5. The vacuumizing sealing tank according to claim 4, wherein there are two guide grooves provided symmetrically, and correspondingly, there are two guide portions provided radially and symmetrically and two lock grooves provided radially and symmetrically.

6. The vacuumizing sealing tank according to claim 1, wherein a decorating cover plate is provided in the installation cavity, the decorating cover plate is provided with a spacing hole, and the pressing button passes the spacing hole to extend upwards.

7. The vacuumizing sealing tank according to claim 1, wherein the cover is provided with an installation hole communicating outside and the accommodating cavity; the deflating component includes a button member, a deflating spring and a deflating sealing ring; the button member is provided movable up and down in the installation hole, a lower end of the button member extends into the accommodating cavity, the deflating spring sheathes an upper end of the button member and pushes the button member to move upwards, the deflating sealing ring sheathes the lower end of the button member and is located in the accommodating cavity, and the deflating sealing ring seals or opens a lower opening of the installation hole as the button member moves up and down.

8. The vacuumizing sealing tank according to claim 7, wherein the installation hole is located beside the installation cavity.

9. The vacuumizing sealing tank according to claim 1, wherein the cover is provided with a sealing ring clamped between the cover and the body to seal the opening of the accommodating cavity.

* * * * *